US006470528B1

(12) United States Patent
Connolly

(10) Patent No.: US 6,470,528 B1
(45) Date of Patent: Oct. 29, 2002

(54) ADJUSTABLE ELEVATOR CABLE CLEANING APPARATUS

(76) Inventor: Michael Connolly, 60-17 54th Ave., Maspeth, NY (US) 11378-1203

( * ) Notice: Subject to any disclaimer, the term of this patent is extended or adjusted under 35 U.S.C. 154(b) by 0 days.

(21) Appl. No.: 09/519,805

(22) Filed: Mar. 6, 2000

(51) Int. Cl.[7] ..... B66B 7/12

(52) U.S. Cl. ..... 15/256.6; 187/414; 184/15.1; 474/92; 198/496

(58) Field of Search ..... 15/256.6; 184/15.1; 187/414; 198/496; 474/92

(56) References Cited

U.S. PATENT DOCUMENTS

| | | | | | |
|---|---|---|---|---|---|
| 317,603 | A | * | 5/1885 | Wilson et al. | 474/92 |
| 556,733 | A | * | 3/1896 | Byrne | 474/92 X |
| 575,520 | A | * | 1/1897 | Grupelli | 474/92 |
| 584,238 | A | * | 6/1897 | Reagan | 474/92 |
| 936,297 | A | * | 10/1909 | Bowen | 198/496 X |
| 1,704,750 | A | * | 3/1929 | Lunn | 474/92 |
| 3,434,273 | A | * | 3/1969 | Lovell | 474/92 X |
| 5,036,563 | A | * | 8/1991 | Liebing | 15/256.6 |
| 5,386,882 | A | * | 2/1995 | Friend | 184/15.1 X |
| 5,784,752 | A | * | 7/1998 | Barrett et al. | 15/256.6 |

FOREIGN PATENT DOCUMENTS

| | | | | |
|---|---|---|---|---|
| DE | 15345 | * | 10/1881 | 184/15.1 |
| DE | 5907 | * | 9/1891 | 474/92 |
| GB | 24334 | * | 10/1897 | 474/92 |
| IT | 435967 | * | 5/1948 | 15/256.6 |
| JP | 4-169493 | * | 6/1992 | 187/414 |

* cited by examiner

*Primary Examiner*—Mark Spisich
(74) *Attorney, Agent, or Firm*—Ostrolenk, Faber, Gerb & Soffen, LLP

(57) ABSTRACT

An elevator cable cleaning apparatus employing wire brushes. The brushes are securely mounted to brush frame members which are in turn adjustably connected to mounting members. The mounting members are adjustably connected to the legs or frame of the hoist machine of the elevator brush frame members. The adjustable connection of the mounting members allows the brushes to be configured to match the angle of the cables. The apparatus can be configured either in a single or dual brush assembly in order respectively clean one side or opposite sides of the cables.

18 Claims, 6 Drawing Sheets

ADJUSTABLE ELEVATOR CABLE CLEANING APPARATUS

FIELD OF THE INVENTION

The present invention generally relates to devices for cleaning wire cables and more particularly to a wire brush cleaning assembly with an adjustable frame.

BACKGROUND OF THE INVENTION

The conventional manner in which elevators are operated is by the hoisting and lowering of the elevator car by wire cables. The wire cables are constructed of individual strands of wire that are twisted to form the cables. Typically, five to six such cables are required for each elevator car installation, depending on the load rating of the elevator and length of the elevator's run.

FIG. 1 is a simplified illustration of a single elevator installation 10. The cables 100 extend from the elevator car 110, over the hoist machine 130 and offset wheel 120 to the counterweight 140. The offset wheel 120 is required to offset the elevator car 110 from the counterweight 140 such that each will not interfere with the travel of the other. The hoist machine 130 is typically installed on the top or intermediate floor 150 of the building and is supported by legs 135.

As seen FIG. 1, at least one side of the cables separate from the hoist machine 130 substantially perpendicular to the floor 150, while the other side of the cables separate from the machine 130 at an oblique angle. This angle is caused by the above described offset required between the counterweight 140 and the car 110. From the machine 130, the cables 100 pass through two holes 160, 170 in the floor 150 to reach the car 110 and the weight 140 respectively.

The cables 100 require lubrication in order to operate properly. In the course of operation, the cables 100 become caked with contaminants that adhere to the lubricant and to the cables 100 themselves. The contaminants consist essentially of dirt and dust. For safety reasons, the cables 100 must be by periodically cleaned to remove the contaminants. Cables have usually been cleaned by hand using rags, lubricant and a wire brush. Often, cleaning was performed while the cables were in operation since halting use of the elevator for manual cleaning of cables could take the elevator out of service for several hours. As the cables typically travel at 1,400 feet/minute, manual cleaning is an inherently dangerous operation.

U.S. Pat. No. 5,386,882 (the '882 patent) discloses an apparatus for mechanically holding a pair of brushes on either side of the cables 100 (in FIG. 1 hereof). As seen in FIG. 2, the apparatus of the '882 patent includes a U shaped holder 180 that is bolted directly to the floor in the area of the holes through which the elevator cables pass. This U shaped holder 180 suffers from two significant disadvantages. First, there is no means by which the holder 180 can compensate for the above described angled orientation of the cables 100 on one side of the machine 130 (see FIG. 1). Accordingly, only the top row or top few rows of the bristles of the wire brush actually contact the cables to effect the cleaning. Secondly, most new configurations of machines 130, as illustrated in FIG. 1, are supported by legs 135. These legs 135 allow the machine 130 to be positioned such that the hole 160 is essentially under the machine 130 and only the front side of the cables 100 are accessible. As a result, the U shaped holder 180 of the '882 patent cannot even be installed because one or the other legs of the U shaped frame 180 interferes with the machine 130 itself.

It is therefore an object of the present invention to provide a cleaning apparatus that can adjust both for an angled orientation of cables and for tight installation configurations.

SUMMARY OF THE INVENTION

The present invention is a cleaning apparatus used for cleaning and maintaining elevator cables. The actual cleaning function is performed by wire brushes. Each brush is securely mounted to its own brush frame member. The brush frame members are adjustably connected to mounting members. The mounting members include first and second transverse mounting members that are adjustably connected in a transverse manner to the brush frame members. The mounting members are in turn adjustably connected to the legs or frame of the hoist machine of the elevator and not to the floor beneath the legs or frame. The brush frame members and the transverse mounting members are configured such that the bristles of the brushes contact the cables in order to perform the cleaning operation.

In a first embodiment of the present invention, two brush frame members are attached to the transverse mounting members in an opposing manner such that the bristles of each of the brushes face the bristles of the opposing brush. In this embodiment, both sides of the elevator cables can be cleaned using the two brushes. In an alternative embodiment, only a single brush is used to clean only a single side of the cables. In this embodiment, only a single brush frame member is employed to mount the single brush on the transverse mounting members. In a second alternative embodiment, legs are adjustably attached to the ends of the transverse mounting members farthest away from the hoist machine. The attachment of the legs to the transverse mounting members can be adjusted to match the angle of the face(s) of the brush(es) to the angle of the cables. This second alternative embodiment can be used with either the single or dual brush embodiments described above.

BRIEF DESCRIPTION OF THE DRAWINGS

For the purposes of illustrating the present invention, there is shown in the drawings a form which is presently preferred, it being understood however, that the invention is not limited to the precise form shown by the drawing in which.

DETAILED DESCRIPTION OF THE INVENTION

Figure 1:
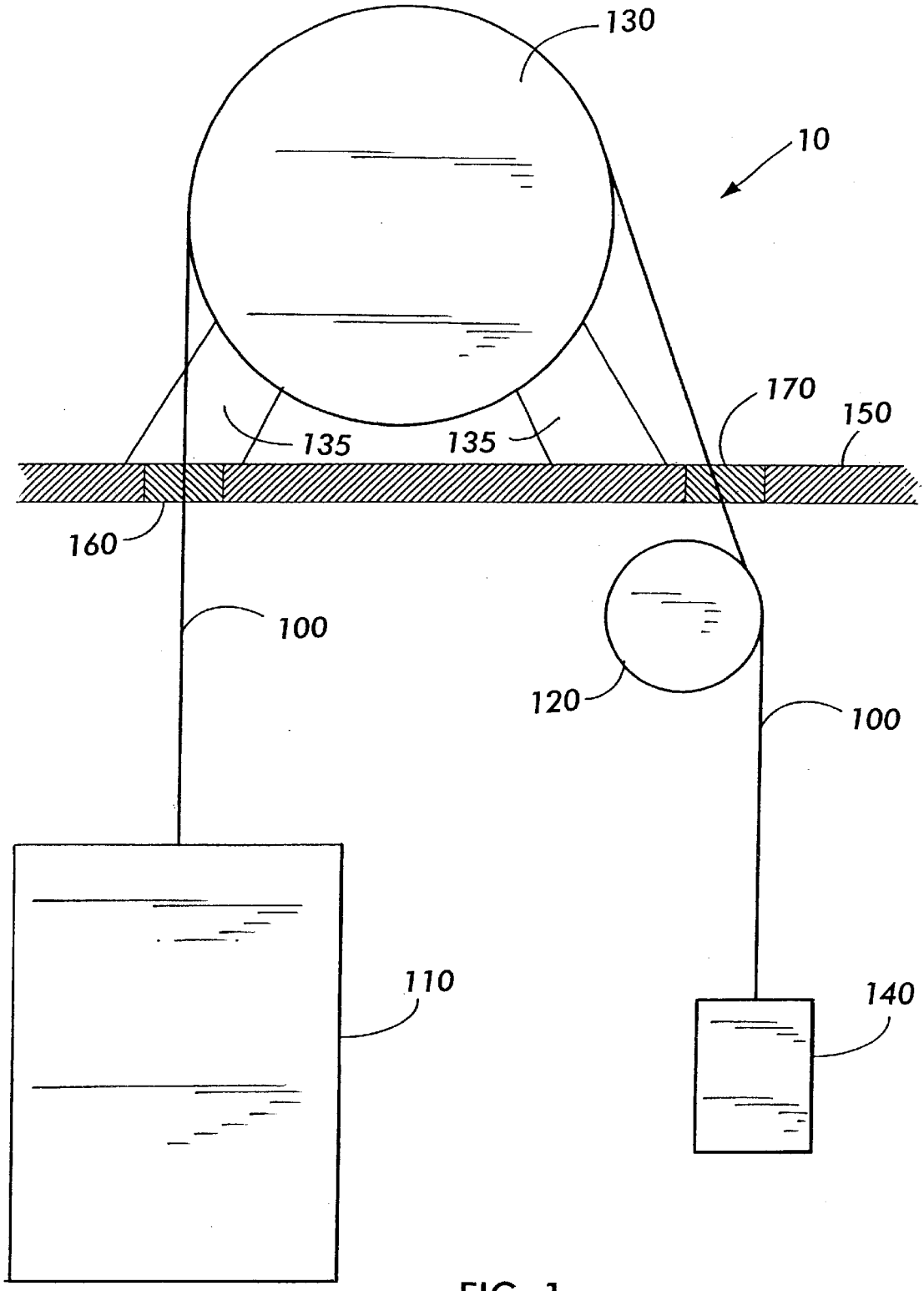
FIG. 1 PRIOR ART
FIG. 1 illustrates a typical prior art elevator assembly construction.
Figure 2:
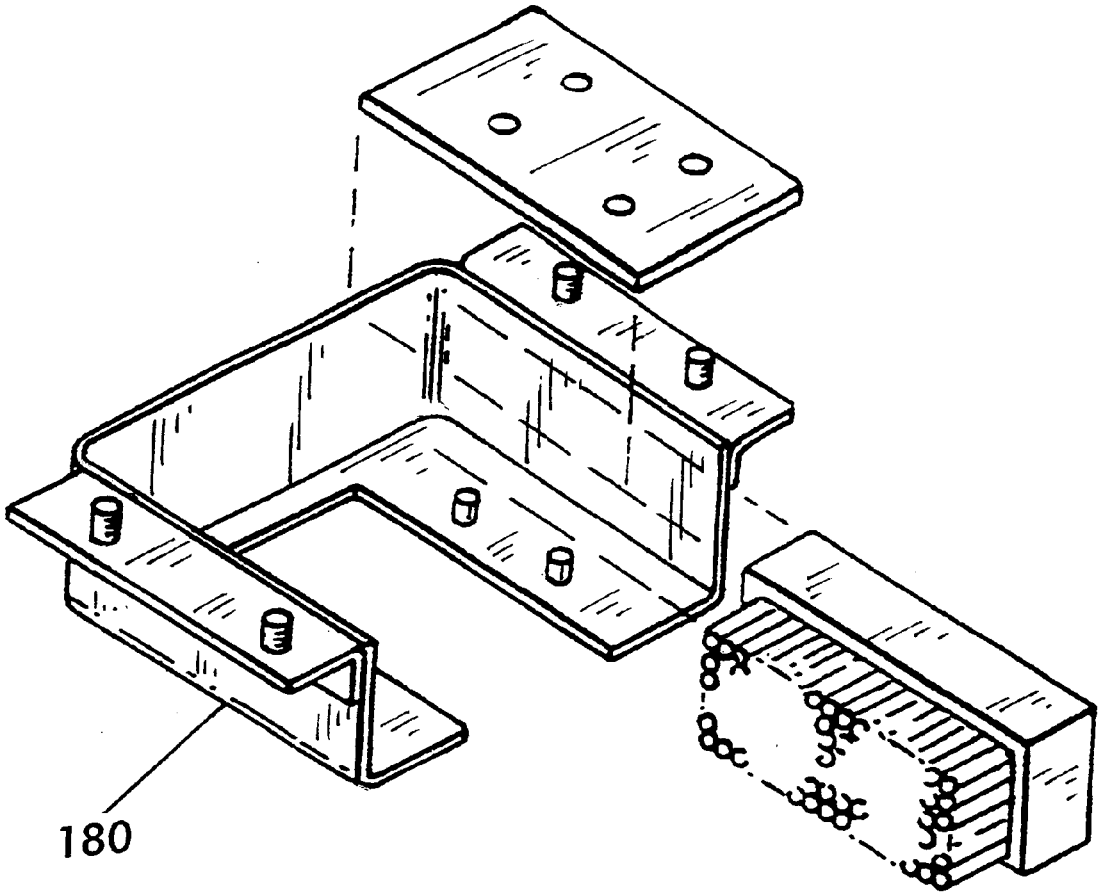
FIG. 2 PRIOR ART
FIG. 2 depicts a prior art cable cleaning apparatus.
Figure 3:
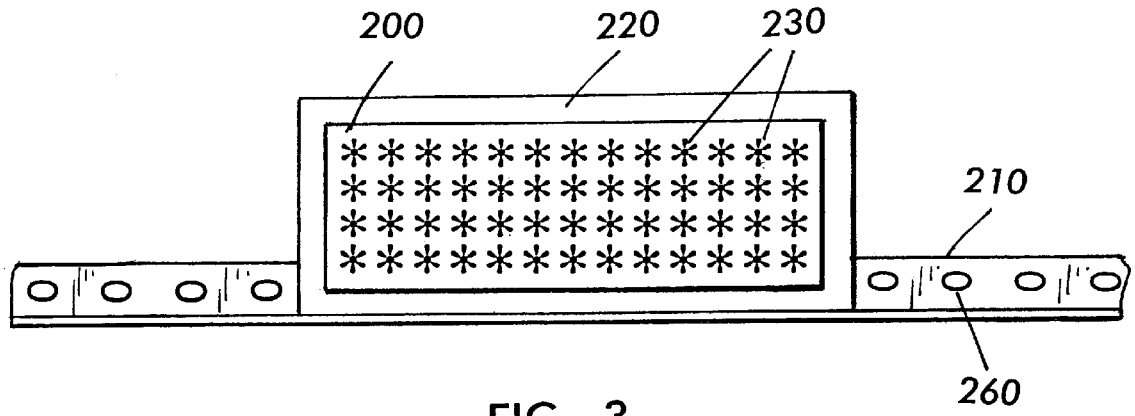
FIG. 3 is a front view of a brush and brush frame member.
Figure 4:
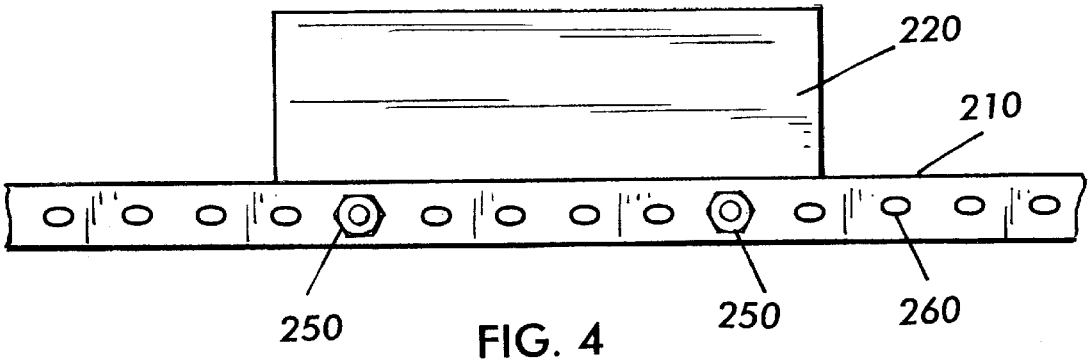
FIG. 4 is a rear view of a brush and brush frame member.
Figure 5:
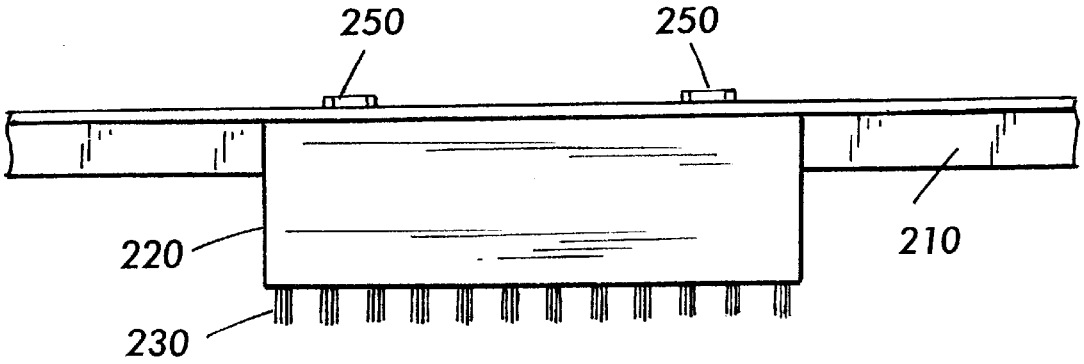
FIG. 5 is a top view of a brush and brush frame member.

FIGS. 3–5 illustrate a wire brush 200 mounted on the brush frame member 210 of the present invention. The brush 200 is preferably mounted in a metal housing 220 to provide a sturdy support for the brush 200. As seen in FIG. 5, the bristles 230 of the brush 200 extend from the face of the metal housing 220. The housing 220 allows for quick (minutes) replacement of worn or contaminated brushes 200. The housing 220 further allows the apparatus of the present invention to be left in place, unattended, for a long period of time without fear that the brush 200 will become unstable and perhaps become entangled with the elevator equipment.

The assembly of the brush 200 and the housing 220 is mounted to the brush frame member 210 by fasteners 250. In a preferred embodiment, the fasteners 250 are bolts, but may be any other suitable fastener such as screws. The fastener 250 should secure the brush 200 and housing 220 assembly to the brush frame member 210 without effect from the vibrations experienced by the apparatus during the cleaning operation. In the preferred embodiment, the brush frame member 210 is a slotted 1 ½ inch (3.8 cm) angle iron. The slots 260 in the angle iron 210 allow for the adjustable placement of the brush 200 and housing 220 assembly on the brush frame member 210. In an alternative embodiment, the housing 220 can be permanently attached to the brush frame member, e.g., through welding.

Figure 6:
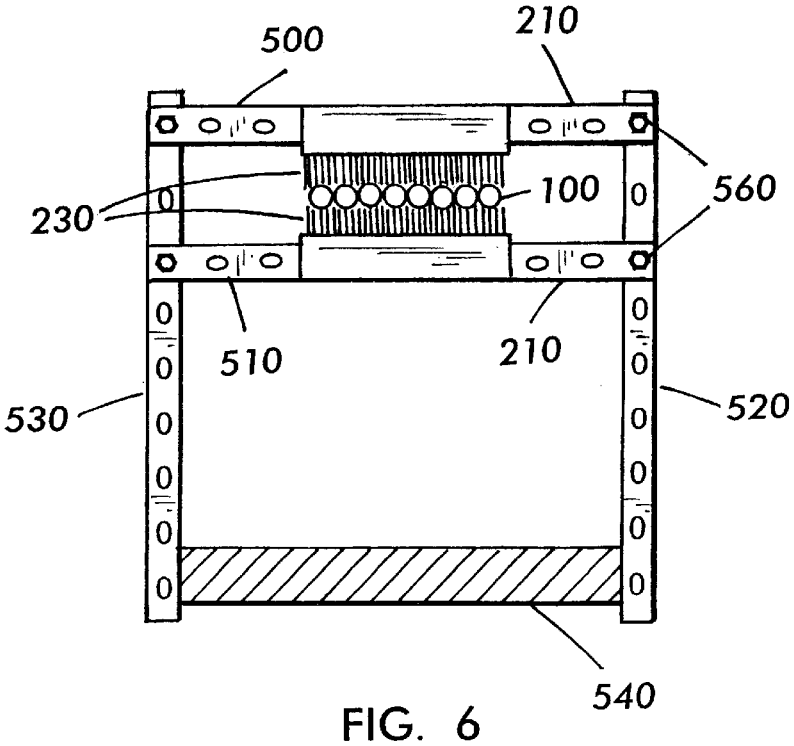
FIG. 6 illustrates a two brush cleaning installation.

FIG. 6 illustrates a two brush cleaning installation in which two brushes 200 are used for cleaning. This installation includes first 500 and second 510 brush assemblies. Each brush assembly 500, 510 comprises the brush 200, housing 220 and brush frame member 210 assembled as described above. In the two brush installation illustrated in this Figure, the two brush assemblies 500, 510 are positioned in an opposed manner with the cables 100 disposed therebetween. The bristles 230 of each brush 200 should only slightly contact the cables 100 as only slight pressure is required to accomplish the cleaning operation.

The brush frame members 210 of each of the brush assemblies 500, 510 are adjustably connected to two transverse mounting members 520, 530 by fasteners 560 such as bolts or C-clamps. In the preferred embodiment, the transverse mounting members 520, 530 are slotted angle irons similar in 10 construction to the brush frame members 210. The slots in the transverse mounting members 520, 530 and the brush frame members 210 allows the members 520, 530 and 210 to be coupled in a variety of adjustable positions. Adjustments can be made in two degrees of freedom, either along the length of the transverse mounting members 520, 530 (into and out from the machine, see FIGS. 7 and 8) and along the length of the brush frame members 210 (in the right and left directions of the top view of FIG. 5). A support member 540 can be connected to the distal ends of the transverse mounting members 520, 530. The support 540 provides the entire apparatus with additional stability. Although the lengths of the brush frame members 210 are shown in FIGS. 5 and 6 as extending well beyond the ends of the brushes 200 and housings 220, the brush frame members 210 may be substantially the same length as the brushes 200, with protruding ends for attachment to the transverse mounting members 520, 530. In this manner, a very compact assembly is achieved for use in tight installation situations.

The adjustable connections between the transverse mounting members 520, 530 and the brush frame members 210 are preferably realized through an easily installed fastener 560. For example, nut and bolt assemblies can be used to couple the members 520, 530, 210 and 540. As alternative means of fastening, it has been found that C-clamps provide the requisite coupling force with the additional benefit of easy assembly and disassembly. The C-clamps are additionally advantageous since the position of the brush frame members 210 must be adjusted occasionally to account for the wear of the bristles 230. It has been found that the apparatus can perform a complete cleaning in approximately a week or two after installation. During that period, the bristles 230 wear somewhat and the brush frame members 210 must be inwardly moved (toward the cables 100) such that the bristles 230 lightly contact the cables 100. The use of C-clamps greatly facilitated this adjustment.

Although not specifically illustrated in FIG. 5, the entire apparatus is coupled to the hoist machine 130 (see FIG. 7), either by the transverse mounting members 520, 530 or by the brush frame members 210, whichever is most convenient. As each of the members 520, 530 and 210 is preferably comprised of the above described angle irons, at least one of the members 520, 530, 210 (preferably a pair) will have a surface that is parallel to and capable of being coupled to the machine 130. Preferably, the apparatus is coupled to the leg support 135 of the machine 130 (see FIG. 7). As described above, the attachment of the transverse mounting members 520, 530 to the brush frame members 210 is adjustable to account for different distances between the locations on the machine 130 to which the apparatus may be connected. In a preferred embodiment, the coupling between the apparatus and the machine 130 is accomplished with C-clamps (see FIG. 8). In addition to the above described benefits of easy assembly and disassembly, the use of C-clamps eliminates the need to make permanent attachment modifications to the machine 130 (e.g., drilling holes for bolts).

Figure 7:
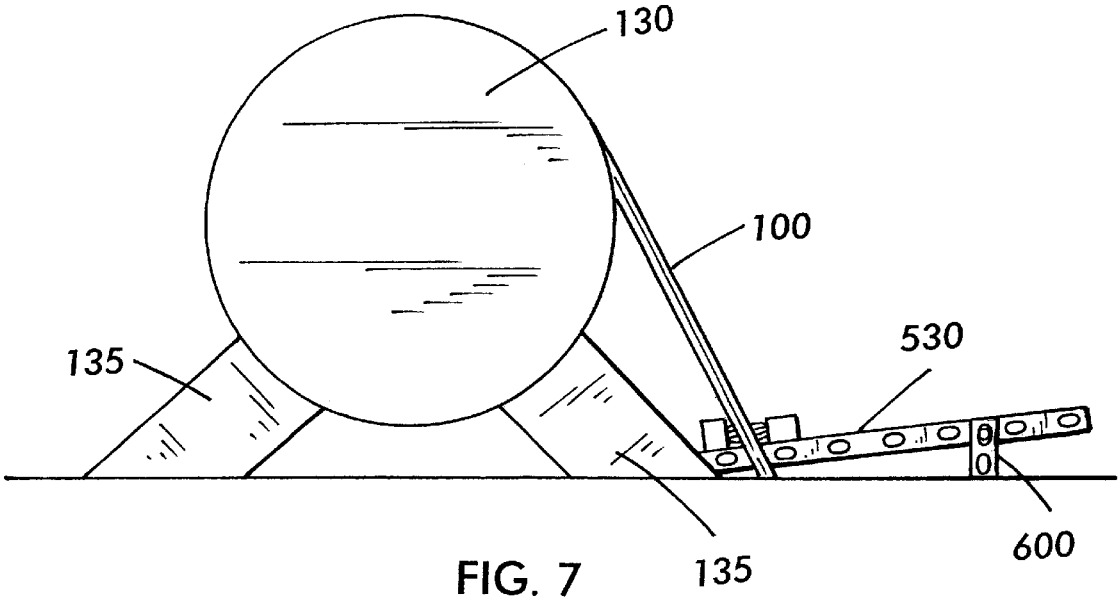
FIG. 7 illustrates the angle adjustment of the apparatus of the present invention.

FIG. 7 illustrates the angle adjustment feature of the apparatus of the present invention. As previously described, and as illustrated in FIG. 5, the cables 100 leaving one side of the hoist machines are typically inclined at an angle with respect to the floor. Often, the other side of the machine is inaccessible and a cleaning apparatus can only be installed on the angled side. In such a case, the cleaning devices of the prior art are ineffective since they cannot take into account the angle of the cables. The present invention solves this problem by additional legs 600. Although not visible in FIG. 7, there are two legs 600, one attached to transverse mounting member 520 and one to member 530.

Preferably, legs 600 are again formed from slotted angle irons which allow for the vertical adjustment of the connection between the transverse mounting members 520, 530 and the legs 600. By adjusting the height of this connection, the apparatus of the present invention is able to adjust for the particular angle of the cables 100 being cleaned. The greater the height of the connection, the greater the angle of the cables 100 that can be accommodated. The prior art device described above is incapable of the angular adjustment provided by the present invention since that device is permanently attached to the floor.

Figure 8:
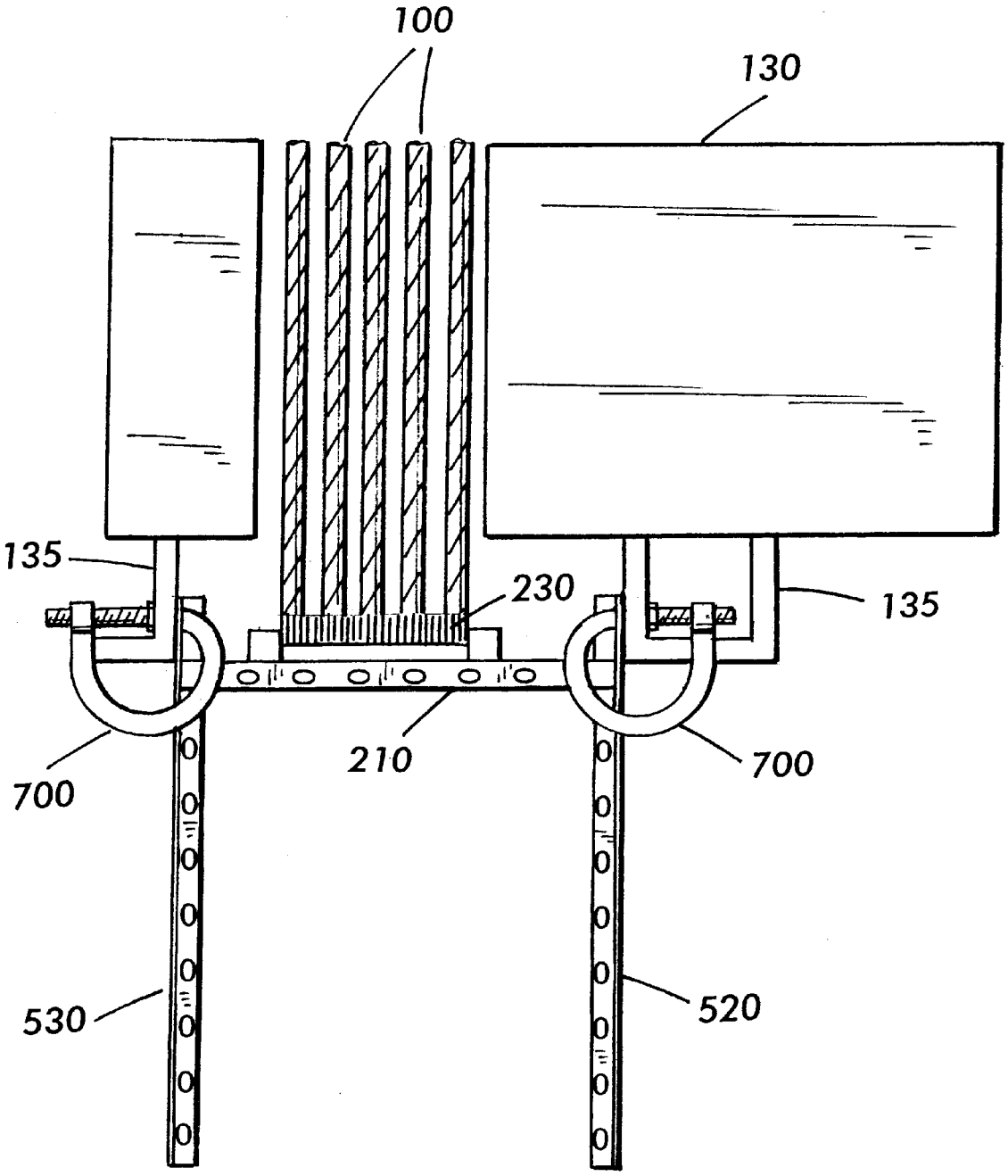
FIG. 8 illustrates a single brush cleaning installation.

Once again, the connection between the transverse mounting members 520, 530 and the legs 600 can be made with any suitable removable fastener such as nuts and bolts or C-clamps (see FIG. 8). Alternatively, if the apparatus is to be permanently installed, the connections can be made permanent, such as through welding. Permanent installation is not required, as the present invention is capable of cleaning cables 100 typically within two weeks of installation.

FIG. 8 illustrates a single brush cleaning installation. As with the two brush installation depicted in FIGS. 6 and 7, the single brush installation of FIG. 8 includes a brush 200 and housing 220 coupled to a brush frame member 210, which is in turn coupled to the transverse mounting members 520, 530. FIG. 8 further depicts the coupling of the transverse mounting members 520, 530 to the legs 135 of the hoist machine 130 by C-clamps. Although not specifically illustrated in FIG. 8, the single brush installation can include the cross support 540 for additional stability, as well as the legs 600 for angular adjustment.

The single brush installation is typically used for situations when it is impossible to fit the second brush 200 in the space between the cables and the hoist machine 130. The prior art device described above is incapable of being used in such an installation since its fixed U shaped frame often cannot be accommodated in the tight space. Although the single brush assembly only cleans one side of the cables 100, such cleaning is preferable to the manual process described above.

Figure 9:
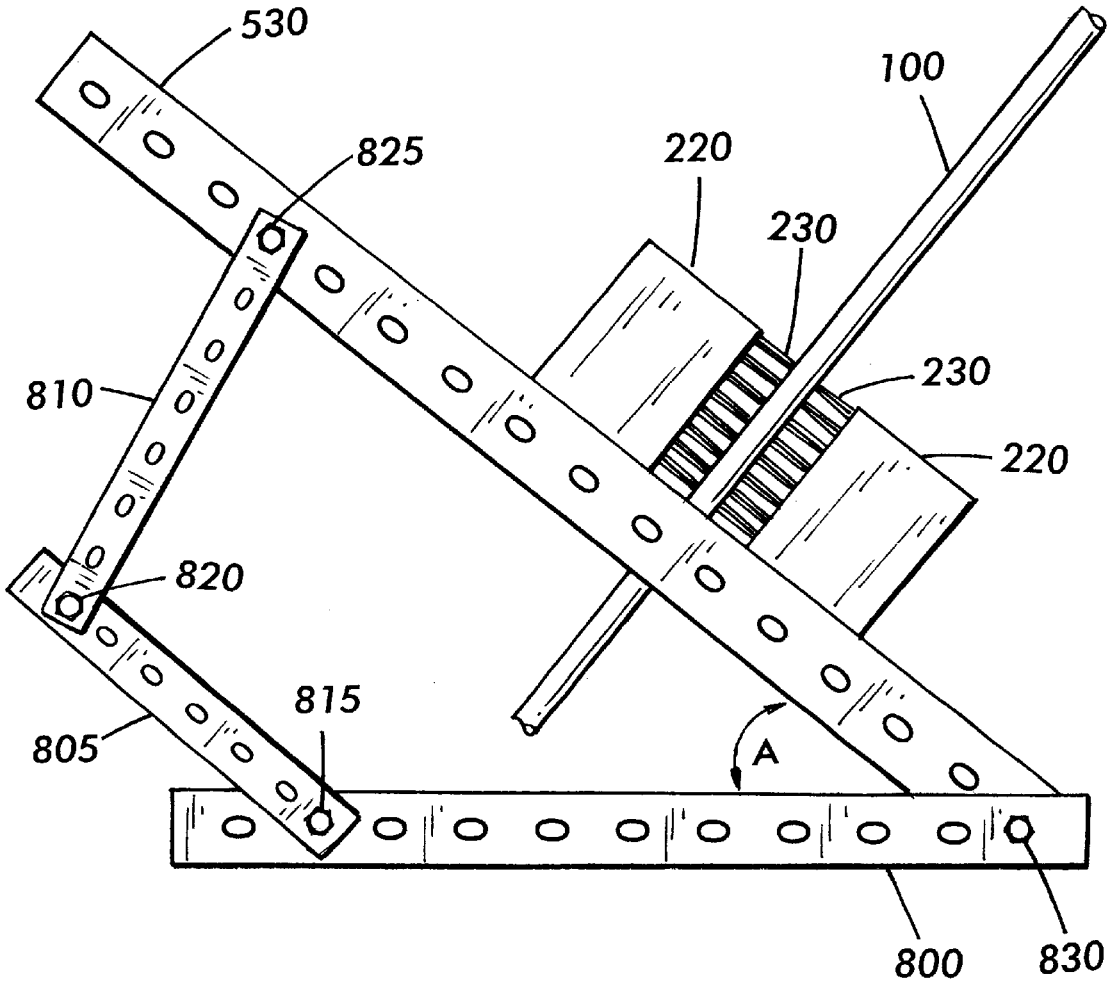
FIG. 9 depicts an alternative embodiment for achieving angle adjustment.

FIG. 9 illustrates an alternative embodiment of the present invention used to achieve an angular adjustment of the bristles 230. As previously described with respect to FIG. 7, one method of realizing an angular adjustment of the brushes is to employ legs 600 a distal end of the transverse mounting members 520, 530. In the alternative embodiment shown in FIG. 9, a hinged assembly comprising elements 800, 805 and 810 are used to raise the proximal end of transverse mounting members 520, 530 in order to attain the proper angle of the bristles 230 with respect to the elevator cables 100. FIG. 9, being a side view only illustrates one side of the apparatus. It is appreciated that members corresponding to elements 800–825 exist on the opposite side of the apparatus.

Base member 800 is attached to the transverse mounting members 530 via fastener 830, preferably a bolt and nut assembly. Hinge members 805 and 810 are respectively attached to base member 800 and transverse mounting members 530 by fasteners 815 and 825. The two hinge members 805 and 810 are coupled by fastener 820. In the initial construction and placement of the apparatus, each of the fasteners 830, 815, 820 and 825 loosely couples their respective members. The members 530, 810 and 805 are then adjusted such that the angle of the bristles 230 match the angle of the elevator cables 100 that are to be cleaned. Once members 530, 810 and 805 are in the proper position to provide the required angle, the fasteners 830, 815, 820 and 825 are tightened to lock the members 530, 810 and 805 in the position.

Although the present invention has been described in relation to particular embodiments thereof, many other variations and other uses will be apparent to those skilled in the art. It is preferred, therefore, that the present invention be limited not by the specific disclosure herein, but only by the appended claims.

I claim:

1. An apparatus for cleaning elevator cables, the cables being coupled to a hoist machine for raising and lowering an elevator car, the apparatus comprising:

a brush mounting support;

a wire brush securely coupled to the brush mounting support;

two transverse mounting members, the brush mounting support being adjustably coupled between and along the length of the two transverse mounting members and the wire brush being adjustably coupled to and along the length of the brush mounting support, and each of the two transverse mounting members capable of adjustable coupling to the hoist machine.

2. The apparatus of claim 1, further comprising a plurality of fasteners, wherein the brush mounting support and the two transverse mounting members each have a plurality of apertures therein, the plurality of fasteners cooperating with the plurality of apertures to provide the adjustable coupling between the brush mounting support and the two transverse mounting members.

3. The apparatus of claim 2, wherein the brush mounting support and the two transverse mounting members are slotted angle irons.

4. The apparatus of claim 1, wherein the cables are inclined at an angle with respect to a floor on which the hoist machine is installed, the apparatus further comprising:

two leg members, one leg member adjustably attached to each of the two transverse mounting members, the two leg members altering a height of the two transverse mounting members such that an angle of the brush corresponds to the angle of the cables.

5. The apparatus of claim 4, further comprising C-clamps positioned for adjustably coupling the two transverse mounting members and the two leg members.

6. The apparatus of claim 4, further comprising bolts providing adjustable coupling between the two transverse mounting members and the two leg members.

7. The apparatus of claim 1, wherein the brush has bristles, the apparatus further comprising a brush housing, the brush being disposed in the brush housing such that the bristles extend out from the brush housing.

8. The apparatus of claim 1, wherein the two transverse mounting members are adjustably coupled to legs of the hoist machine.

9. The apparatus of claim 1, wherein the two transverse mounting members are adjustably coupled to the hoist machine at proximal ends thereof, the apparatus further comprising a cross support coupled between the two transverse mounting members at distal ends thereof.

10. The apparatus of claim 1, further comprising C-clamps for adjustably coupling the brush mounting support and the two transverse mounting members.

11. The apparatus of claim 1, further comprising C-clamps for adjustably coupling the two transverse mounting members and the hoist machine.

12. The apparatus of claim 1, further comprising bolts for adjustably coupling the brush mounting support and the two transverse mounting members.

13. An apparatus for cleaning elevator cables, the cables being coupled to a hoist machine for raising and lowering an elevator car, the apparatus comprising:

a first and a second brush mounting support;

a first wire brush securely coupled to the first brush mounting support, the first wire brush having bristles;

a second wire brush securely coupled to the second brush mounting support, the second wire brush having bristles; and two transverse mounting members, the first brush mounting support being adjustably coupled between the two transverse mounting members and being so placed that the bristles of the first brush contact an inside surface of the cables, the second brush mounting support being adjustably coupled between the two transverse mounting members and being so placed that the bristles of the second brush contact an outside surface of the cables, each of the two transverse mounting members being adjustably coupled to the hoist machine.

14. The apparatus of claim 13, wherein the cables are inclined at an angle with respect to a floor on which the hoist machine is installed, the apparatus further comprising:

two leg members, one leg member adjustably attached to each of the two transverse mounting members, the two leg members altering a height of the two transverse mounting members such that an angle of the first and second brushes corresponds to the angle of the cables.

15. The apparatus of claim 13, wherein the cables are inclined at an angle with respect to a floor on which the hoist machine is installed, the apparatus further comprising:

two base members, one base member hingeably attached to each of the two transverse mounting members;

two pairs of hinge members, each pair of hinge members respectively coupled between one base member and one traverse mounting member, the two pairs of hinge members altering a height of the two transverse mounting members such that an angle of the first and second brushes corresponds to the angle of the cables.

16. The apparatus of claim 13, the apparatus further comprising first and second brush housings, the first and second brushes being disposed respectively in the first and second brush housing such that the bristles of each brush extend out from the respective brush housing.

17. The apparatus of claim 13, wherein the two transverse mounting members are adjustably coupled to legs of the hoist machine.

18. The apparatus of claim 13, wherein the two transverse mounting members are adjustably coupled to the hoist machine at proximal ends thereof, the apparatus further comprising a cross support coupled between the two transverse mounting members at distal ends thereof.

* * * * *